United States Patent [19]

Gomberg

[11] Patent Number: 4,772,379

[45] Date of Patent: Sep. 20, 1988

[54] EXTRACTION AND LIQUEFACTION OF FOSSIL FUELS USING GAMMA IRRADIATION AND SOLVENTS

[75] Inventor: Henry J. Gomberg, Ann Arbor, Mich.

[73] Assignee: Ann Arbor Nuclear, Inc., Ann Arbor, Mich.

[21] Appl. No.: 792,388

[22] Filed: Oct. 29, 1985

[51] Int. Cl.[4] ..... C10G 1/00

[52] U.S. Cl. ..... 208/402; 208/431; 204/157.63

[58] Field of Search ..... 208/402, 431; 204/157.63

[56] References Cited

U.S. PATENT DOCUMENTS

| | | | |
|---|---|---|---|
| 1,627,938 | 5/1927 | Tingley | 208/113 |
| 2,221,866 | 2/1938 | Dreyfus | 208/431 X |
| 2,595,979 | 5/1952 | Pevere et al. | 208/431 X |
| 2,686,152 | 8/1954 | Franke | 208/431 X |
| 2,906,680 | 9/1959 | Ruskin | 208/402 X |
| 3,224,954 | 12/1965 | Schlinger et al. | 208/11 |
| 3,244,615 | 4/1966 | Huntington | 208/97 |
| 3,652,447 | 3/1972 | Yant | 208/11 |
| 4,153,533 | 5/1979 | Kirkbride | 208/11 |
| 4,162,959 | 7/1979 | Duraiswamy | 208/8 |
| 4,187,167 | 2/1980 | Havlik et al. | 208/8 |
| 4,312,740 | 1/1982 | Chiaramonte | 208/11 |
| 4,319,982 | 3/1982 | Meisenburg | 208/11 R |
| 4,348,274 | 9/1982 | Guerre | 209/2 |

OTHER PUBLICATIONS

"Coal Combustion and Conversion Technology", MacMillan Publishers Ltd., 1984, Chapter 5, entitled Liquification.

"Coal Conversion Technology", Addison-Wesley Publishing Company, 1979, Portions of Chapter 4.

"Radiation-Thermal Cracking of Coal", Pergamon Press Ltd., 1981, pp. 817-826.

*Primary Examiner*—Helen M. S. Sned
*Assistant Examiner*—Glenn Caldarola
*Attorney, Agent, or Firm*—Harness, Dickey & Pierce

[57] ABSTRACT

A new technology for the extraction of liquid hydrocarbon products from fossil fuel resources such as oil shales, tar sands, heavy oils and coals which comprises the mixing of a donor solvent with the fossil fuel and the exposure of the mixture to ionizing radiation. The donor solvent supplies hydrogen for combination with molecules whose bonds are broken by the irradiation process. The method may be conducted at or above ambient temperatures and pressures.

7 Claims, No Drawings

EXTRACTION AND LIQUEFACTION OF FOSSIL FUELS USING GAMMA IRRADIATION AND SOLVENTS

BACKGROUND AND SUMMARY OF THE INVENTION

This invention relates generally to the processing of fossil fuels, and in particular it relates to new and improved methods for the processing of certain fossil fuels such as oil shales, tar sands, heavy oils and coal.

Liquid fuels are an important energy source in many countries of the world not only for economic, but also for national security reasons. At the present time in history, geo-political factors can bear on the availability of useful liquid fuels in those nations which do not have ample fossil fuel supplies and/or the appropriate processing capabilities to convert the particular fossil fuels into liquid forms.

Severe disruptions in the world petroleum supply in the 1970's gave rise to two energy crises in the United States in that decade. Extensive interest was generated in alternate fuel supplies and considerable resources were devoted to various developmental programs involving geo-thermal, solar, and other non-conventional sources, along with an extensive program whose objective was the development of large-scale synthetic fuel operations.

Although the United States contains substantial fossil fuel reserves, its petroleum reserves have been unable to supply its total demand for liquid fuel, and therefore importation of petroleum has been required to meet the domestic demand. When a rising price for petroleum was imposed by those external forces referred to above, significant attention was devoted to the development of non-petroleum fossil fuels such as coals, oil shales and tar sands. It is estimated that the United States contains reserves of these non-petrolerm fossil fuels sufficient to handle the United States' energy needs for at least several hundred years. The problem, however, arises in converting them economically into useful forms for the various applications of hydro carbon-based energy, generally gases and light liquids.

Various technologies have been proposed for extracting liquids or gases from these non-petroleum hydrocarbon-bearing resources and many were known long before the energy crises of the 1970's. In general, the net energy recovery using these technologies have been economically unfavorable in comparison to the economics of conventional petroleum sources, even at the historical price escalations in crude oil which have essentially remained in place since the energy crises of the 1970's.

Certain other countries of the world are in the same type of energy situation as is the United States. They are net importers of petroleum, but possess local reserves of non-petroleum fossil fuels which could supply domestic liquid fuel needs if suitable technology were available.

Non-economic considerations may also come to bear on the development and expansion of fuel resources, including not only conventional fuel sources, but also non-conventional ones. A specific example is the case of nuclear energy where the consequences of uncontrolled exposure to large doses of nuclear radiation are well-documented.

Nuclear energy has the potential for freeing certain types of energy generation from dependence on liquid or hydrocarbon fuels. For example. nuclear power can be used in place of oil, gas or coal for firing an electric generating plant.

Environmental concerns about the use of nuclear energy, whether legitimate or otherwise, have retarded the domestic expansion of nuclear energy, and today it is not unreasonable to express fear that further significant development of nuclear-electric power facilities will take place very slowly in the United States.

While at the present time in history there are ample supplies of petroleum and other energy sources, there is no guarantee that this favorable situation will continue. Indeed, the United States continues to be dependent upon imported petroleum to a very significant extent. Any future disruption in petroleum imports will create consequences similar to or even more serious than those experienced in the decade of the 1970's.

The technologies which have been proposed for the development of alternate liquid fuel sources, meaning nonpetroleum based resources, take many forms. There is extensive technology on the processing of oil shale and tar sands to extract useful hydrocarbon products. Ther is also substantial technology on the creation of synthetic fuels.

In general it is fair to say that the net energy recoveries from these technologies is such that at today's economics, they are prohibitive to commercial exploitation in a free market.

A representative technology for extracting useful liquid hydrocarbons from tar sands and oil shales comprises subjecting these naturally occurring raw materials to substantial levels of heat and pressure so that as a consequence liquid fractions are obtained. In the case of shale, crushing may be required.

Where such naturally occurring materials are present in ample amounts near the earth's surface, conventional mining procedures can be used to obtain them. Where this is not the case it is necessary to use in situ exploitation with its attendant procedures.

In any event, as noted above, it is fair to say that the net energy recovery using known technologies is not competitive with the present day economics of petroleum.

While it is hoped that the future course of history will not occasion any new energy crises, it is a known fact that the world's recoverable petroleum reserves are finite. Therefore at some point in time it will be necessary to consider alternate fossil fuel sources such as coal, oil shale, and tar sands.

The present invention is directed to a new and improved method for extracting useful hydrocarbons from such fossil fuel resources with a greater net energy recovery than is obtainable using known technologies. Accordingly, the present invention offers significant economic advantage over known technologies because it uses nuclear energy to promote extraction of useful hydrocarbon products from the naturally occurring fossil fuels such as oil shales, tar sands and coal. Stated otherwise, this invention utilizes ionizing radiation applied to the naturally occurring fossil fuel in conjunction with pressure and temperature exposures that are low enough to be reasonable, i.e., cheaper and safer than heretofore used.

In one respect, the present invention obtains its improved efficiency through the use of certain solvents in conjunction with exposure to a certain level of ionizing radiation such as gamma rays, charged particles and neutrons. The usage of solvents in conjunction with gamma irradiation has been shown to have a synergistic effect on the extraction of useful hydrocarbons from oil shales, tar sands, and coal.

In the application of the invention to the processing of oil shale, a preferred procedure for the practice of the invention comprises the use of a hydrogen donor solvent which is driven by the ionizing irradiation to cause extraction of hydrocarbons from oil shale raising the hydrogen-carbon ratio of the extracted material and at the same time eliminate substantial quantities of any sulphur and nitrogen which may be present in the natural shale. The process can be conducted at or near ambient temperatures and pressures so that external energy inputs to the process are minimized and the operating conditions are less demanding and expensive.

The use of hydrogen donor solvents to promote the liquefaction of coal is known. In treatment with heat and pressure, it is believed that there is a transfer of hydrogen from the solvent to the coal and that the hydrogen transfer mechanism is essentially the thermal decomposition of the coal into free radicals. It has been discovered in this invention, as an example, that the donor solvent "n-heptane" possesses synergistic qualities in extraction of hydrocarbon from oil shale when driven by gamma radiation under ambient temperature and pressure. Other donor solvents are also suitable such as the generic groups represented by cyclohexane, tetra hydrofuran (THF) and tetralin.

Others have considered using radiation to promote the extraction of hydrocarbons from tar sands and coal but none have conceived of processes which utilize the donor solvents in combination with the radiation to thus enable the process to be carried out at low temperatures and pressures.

In the case of coal, it has been found that radiation by a gamma source can serve to obtain liquid hydrocarbon products from crushed coal by donor-solvent extraction with the irradiation providing synergistic enhancement.

DESCRIPTION OF THE PREFERRED EMBODIMENT

The use of irradiation in connection with fossil fuel processing has been investigated to a limited extent and has been discussed in published papers on the subject. It has been generally accepted that irradiation of a sample of a liquid hydrocarbon fossil fuel leads to polymerization and thus increased viscosity. Indeed a 1968 report on the "Gamma Irradiation of Coal", Information Circular 8377, issued by the U.S. Department of the Interior, Bureau of Mines, concluded that "coal is not significantly altered by gamma irradiation owing to the resistivity of its highly condensed ring structure. High-level gamma irradiation, therefore, is unlikely to prove advantageous in coal processing and utilization."

While these representations may have general validity under the conditions that prevailed, it has been discovered that they are not absolute truths.

The present invention involves the discovery that ionizing radiation, when used in a particular manner for the processing and upgrading of certain fossil fuels, can provide a recovery which is more favorable than that obtained with other technologies involving high temperatures and pressures, and hence high cost energy inputs.

In general, the invention involves the utilization of ionizing radiation of certain fossil fuel resources in conjunction with the use of certain solvents. Moreover, it can be conducted at or near ambient temperatures and pressures so that the massive energy inputs and equipment required by other technologies become unnecessary. Indeed it has been discovered that there is a synergistic effect between irradiation and particular solvents when carried out according to principles of the invention such that enhanced yields of liquid hydrocarbons can be obtained from solid fossil fuel raw materials, such as oil shale, tar sands and coals.

One aspect of the discovery is that certain solvents are particularly useful in producing such synergism. One of the solvents which has a synergistic effect with irradiation to accomplish depolymerization of the solid material found in oil shale is n-heptane. This solvent is of the type which will be referred to as a donor solvent because it has the ability to donate hydrogen ions to carbon bonds which are broken by irradiation so that liquid hydrocarbon products may thereby be formed.

The irradiation of the fuel and solvent mixture is carried out in either an open air chamber, an evacuated chamber or a chamber filled with the mixture. There is no requirement for a special gaseous atmosphere.

The following examples will demonstrate the synergistic effect of the present invention, and each example includes a baseline reference for comparison.

EXAMPLE I

Two 50 gram samples of granulated oil shale from Ef's Israel were each mixed with 50 cc's donor solvent, n-heptane. One sample in solvent was subjected to 100 Megarad $Co^{60}$ irradiation at the center of an 8 kilocurie cylindrical Cobalt 60 gamma source. The sample was not mechanically stirred during irradiation, which was carried out at ambient temperature (40° C. within the source) and at atmospheric pressure. No protective cover gas was used; the sample was exposed to air. The irradiation took about 6 days. It may be assumed that there was some thermal stirring of the solvent and that the dosage was not truly uniform throughout the shale due to self-shielding.

The control was held at about 40° C. during this period. The two samples were then each put into individual Soxhlet extractors and run for 48 hours. The solvent was then drained into open beakers of known weight. These were stored at 80° C. (Sand Bath) so that all the solvent was evaporated. The yields were measured by re-weighing the beakers.

The solvent-only (no irradiation, i.e., control) run yielded 0.1 grams of a dull, thin, hard plastic-like material coated firmly and fairly uniformly over the bottom and lower half of the walls of the beaker.

The shale irradiated in solvent yielded 0.75 grams of a brown clear liquid of moderate viscosity. It flowed slowly, like honey, at room temperature.

The same shale samples were then each mixed with fresh 50 cc supplies of solvent and the process including irradiation repeated. The samples were again run in Soxhlet extractors for 48 hours, the solvent drained into open, weighed beakers and treated as described above.

The control produced no additional measurable yield. The irradiated sample produced an additional 0.3 grams of a somewhat lighter, less viscous liquid. The total yield was now 1.05 grams: ten times the solvent-only (control) production.

Initial elemental analyses were run with a Perkin Elmer elemental analyzer set up for C—H—N determinations. Sulfur determination was made by activation analysis, using a 2 Megawatt reactor at the University of Michigan.

The yield composition after the second irradiation was:

I. C—76.18%, H—12.6%; N—0.033%, H/C—1.99; S=0.39±0.43%; No measurable residue.

Yield composition for the first irradiation trial was:

II. C—78.10%, H—12.96%, N—0.075%, H/C—1.99; S=1.78±0.78%; No measurable residue.

Yield composition of the control sample was measured with material scraped from the wall of the beaker:

III. C—57.93%, H—8.30%, N—0.31%, H/C—1.72; S=6.10±1.31%; Residue 20.26% (ash).

It is interesting to note that the compositions of a "typical" oil from Ef's shale and a typical raw shale as described in A Guide Book to the Oil Shale Deposits in Israel", M. Shirov and D. Ginzburg (1978) are:

IV. Typical Oil C—79.9%, H—10.2%, N—1.1%, S—7.3%, H/C=1.53

V. Raw Shale C—9.35%, H—1.16%, N—0.24%, S—1.6%, H/C=1.49; (Averaged Data) (organic)

The analysis by the C—H—N analyzer and activation analysis in applicant's laboratory showed:

VI. Raw Shale C—15.35%, H—1.56%, N—0.35%, S—2.0%, H/C=1.21; (total)

The H/C ratio for III above, is higher than that for IV above, a "typical" Israeli shale oil (1.72 vs. 1.53). The N in the solvent extracted sample (non-irradiated) is lower (0.31% vs. 1.1%), but the sulfur values are close (6.1% vs. 7.3%).

More important is the rise in H/C and the rapid decline in N and in S in the irradiated samples:

| | III | | II | | I |
|---|---|---|---|---|---|
| H/C - | 1.72 | → | 1.99 | → | 1.99 |
| N (%) - | 0.31 | → | 0.08 | → | 0.033 |
| S (%) - | 6.1 | → | 1.78 | → | 0.39 |

Also significant is the clarity and low ash content of the oil from irradiated samples as well as the increase in yield; in this case more than 10 times. This can be attributed to the effect of the radiation in breaking the bond between the hydro-carbon molecules and the inorganic matrix.

The hydrocarbon is not only increased in hydrogen content but also becomes a more completely separated phase, making extraction simpler and cleaner.

Based on the evolved odor of the freshly irradiated specimens, it appears that much of the sulfur has been incorporated into light molecules and volatilized.

It appears that the yield increase by bond breakage is particularly important in homogenous shales—such as the Israeli shale—where the kerogen is fairly uniformly distributed through the mass.

The operation was conducted at fairly modest radiation input levels (less than 1 Megarad per hour) and used low Linear Energy Transfer (LET) radiation only. The effects observed should respond to dose rate and to LET. All these factors can have a significant influence on the ultimate economics of the oil production.

EXAMPLE II

Conditions 1 gram of crushed coal as received from Penn State Coal Sample Bank Radiation Dose—75 Megarad Cobalt-60 at 0.84 Megarad per hour.

Ambient Temperature—samples in 20 ml of solvent exposed to air.

Nominal Description of solvent in *absence* of radiation:

A. Donor-solvent

B. Solvent only.

A. I. Control

Crushed coal stored in "donor-solvent" about 1 week. Liquid filtered through filter paper and then evaporated to dryness.

Result: No visible or measurable yield.

A. II. Irradiated

As in I. plus exposure to 75 Megarad.

Result: Small yield of clear "oil" after evaporation of solvent.

B. I. Control

Crushed coal stored in "solvent" as in A. I.

Result: Mixture lightly colored. Filtered liquid when solvent is evaporated yielded dry powder and a small amount of residual heavy dark fluid.

B. II. Irradiated

As in I. plus exposure to 75 Megarad.

Result: Mixture opaque. Yield of filtered liquid, after solvent is evaporated, is about 10× yield for case B. I.

EXAMPLE III

Coal Conversion

Tests were run on crushed PSOC 130 coal as received from Penn State Coal Sample Bank. PSOC 130 is a Pocahontas #3 Medium Volatile Bituminous Coal with the relevant elemental analysis supplied as follows:

Carbon 84.71% Hydrogen 3.94% Nitrogen 1.05%

Atomic Hydrogen/Carbon=0.57

Four samples consisting of nine grams each of coal were then each mixed with 9 milliliters of the donor solvent, tetra hydrofuran (THF). One sample was exposed to $1\times10^8$ Rad of Cobalt 60 radiation at ambient temperature and pressure, a second was exposed to $2\times10^8$ Rad, Cobalt 60, and the last two retained as controls. Dose rate was about $0.6\times10^6$ Rad per hour.

After irradiation, the donor solvent was removed by evaporation of about 125° C. The remaining solid was then processed with pyridine in a Soxhlet extractor. The controls received the same treatment but without radiation.

The extracted material was freed of pyridine at 130° C. and then analyzed for Carbon, Hydrogen and Nitrogen. The results were:

| Rad Dose | Carbon | Hydrogen | Nitrogen | H/C | Yield |
|---|---|---|---|---|---|
| $1\times10^8$ | 78.01% | 7.01% | 1.55% | 1.08 | 0.22 gm |
| control | 84.88 | 6.92 | 2.88 | 0.98 | 0.07 |
| $2\times10^8$ | 76.6 | 7.45 | 1.25 | 1.17 | 0.45 |
| control | 81.1 | 5.98 | 2.53 | 0.88 | 0.08 |

The primary effect of the radiation is seen to be the increased yield of pyridine soluble hydrocarbon. In addition, there is a higher H/C ratio and reduced nitrogen content, all of which demonstrate increased hydrogen transfer from the donor solvent.

For further comparison, tests were run using pyridine as the solvent during irradiation as well as for extraction. The results are:

| Rad. Dose | Carbon | Hydrogen | Nitrogen | H/C | Yield |
|---|---|---|---|---|---|
| $1 \times 10^8$ | 74.9% | 5.51% | 11.06 | 0.88 | 0.238 gm |
| control | 81.0 | 6.12 | 2.76 | 0.91 | 0.126 |
| $2 \times 10^8$ | 76.5 | 4.95 | 9.7 | 0.78 | 0.29 |
| control | 77.5 | 5.44 | 3.7 | 0.84 | 0.07 |

There is, again, an increase in yield in the irradiated case accompanied, however, by a large transfer of nitrogen. The controls show the normal pyridine extraction behavior at low temperature.

Two effects are thus observed. Solvent action is enhanced and, for the donor solvents, donor action is improved. There is also the reduction of nitrogen, much as was observed for oil shale, when a low nitrogen solvent is used.

Heptane, while somewhat less effective, showed marked increase in both solvent action and hydrogen transfer under radiation. Cyclohexane was similar in action to THF.

Softer coal with higher volatile content such as PSOC-1098 showed increases in yield under radiation with all the donor solvents. In later tests, still being evaluated, 10 milliliters of solvent were used with 1 gram of coal. Much larger percentage yields of dissolved coal were obtained.

The term "donor solvent" is used herein to describe solvents that possess the ability to decompose partially and to release hydrogen to the fossil fuel. It is believed that the hydrogen transfer is a free radical reaction in which coal molecules are thermally cleaved into free radicals which seek stabilization. If a donor solvent is present the available hydrogen atom stabilizes this free radical by hydrogen transfer. If a sufficiently active hydrogen donor solvent is used, the hydrogen transfer mechanism is essentially the thermal decomposition of the fossil fuel.

Under ionizing radiation, two effects can be produced:

(a) the fossil fuel (coal) molecule can be cleaved even at low temperature;

(b) a hydrogen donor can be made "active".

While there are good parallels between the thermal case and the radiation driven case, they cannot be carried too far. In general the radiation driven case will be chemically reactive at lower temperature (and pressure), and the most suitable donors may not be the same. All results on which this invention is based have been obtained at room temperature. There are clearly combinations of mildly elevated temperature and pressure with radiation to create the optimum process.

Further examples with respect to oil shale are as follows:

KEROGEN EXTRACTION AND SHALE OIL UPGRADING FROM U.S. SHALES USING DONOR-SOLVENTS AND RADIATION AT AMBIENT TEMPERATURE AND PRESSURE

| SHALE-Origin & Properties | Donor-Solvent | Radiation Dose RAD Cobalt 60 | Yield (Weight Percent of Shale) | C (Perkin-Elmer Elemental Analyzer) | H | H/C | N | S Activation | Ash From C—H—N | Remark |
|---|---|---|---|---|---|---|---|---|---|---|
| "Rich" Colorado[1] | — | — | — | 28.26 | 3.31 | 1.40 | 0.74 | | 50.7 | Raw Shale |
| Kerogen in Segregated Seams | n-Heptane | 0 | See [1] | 83.78 | 12.28 | 1.75 | 0.88 | | 0 | Brown Heavy Resin |
| | n-Heptane | $1 \times 10^8$ | | 80.97 | 13.37 | 1.98 | 0.30 | | 0 | Lt. Brown Syrupy Liquid |
| | n-Heptane | 0 | | 83.33 | 12.65 | 1.82 | 0.79 | 0.23 | 0 | Brown Heavy Resin |
| | n-Heptane | $2 \times 10^8$ | | 83.47 | 14.00 | 2.01 | 0.36 | 0.07 | 0 | Lt. Brown Liquid |
| Kentucky[2] Sunbury | — | — | | 16.41 | 1.98 | 1.44 | 0.52 | | 50.9 | Raw Shale |
| | n-Heptane | 0 | negl. | | | | | | | |
| Kerogen Dispersed Through Shale | n-Heptane | $10^8$ | 1.0 | 84.88 | 14.24 | 2.01 | 0.05 | | neg | Tan Liquid |
| | THF | 0 | 0.62 | 78.86 | 9.34 | 1.42 | 1.51 | | trace | Black Pitch-like |
| | THF | $10^8$ | 2.8 | 66.47 | 9.29 | 1.68 | 0.32 | | 0 | Dk. Brown Viscous Liquid |

Footnotes for table

[1]For "Rich" Colorado shale, kerogen was extracted first, using Soxhlet extractor and donor-solvent. An aliquot of extract in donor-solvent was then irradiated. In qualitative observation of the effect of radiation on extraction, crushed shale was irradiated in donor solvent and then processed. Yield was about 10% greater than non-irradiated control.

[2]For Kentucky Sunbury shale, crushed shale was irradiated in donor-solvent and then processed in Soxhlet extractor.

On the basis of the foregoing examples, it can be seen that a new and useful method has been disclosed which possesses significant advantages over other technologies. It is to be appreciated that although certain ranges, compositions, percentages, etc. have been identified, these are intended to be illustrative and not necessarily limiting in character.

What is claimed is:

1. A method for increasing the yield from certain solid fossil fuel resources such as oil shale, tar sands, and coals at or near ambient temperatures and pressures which comprises hydrogenizing certain of the fossil fuel resource's carbon-based structure by mixing the fossil fuel resource with an n-heptane solvent which acts as a hydrogen-donor, irradiating the mixture with ionizing radiation from a radiation source to activate the hydrogen-donor solvent and fossil fuel resource mixture into associating donor hydrogen from the solvent and recipient molecular carbon-based structure to form free hydrocarbons having molecular weights less than that of kerogen, and extracting the free hydrocarbons from the mixture.

2. A method as set forth in claim 1 in which the ambient temperatures and pressures at which the method is conducted do not exceed approximately 600° F. and approximately 10 atmospheres.

3. An energy-efficient method for the upgrading of certain solid fossil fuel resources in which a significant percentage of hydrocarbons are bound to inorganic matter, said method comprising depolymerizing certain of the bound hydrocarbons in the solid fossil fuel resource and freeing them from the inorganic matter by mixing the solid fossil fuel resource with an n-heptane solvent which acts as a hydrogen-donor, irradiating the mixture with ionizing radiation to activate the liquid hydrogen-donor solvent and bound hydrocarbons into forming free hydrocarbons having molecular weights less than that of kerogen, and extracting the free hydrocarbons from the mixture.

4. A method as set forth in claim 3 in which the mixture is irradiated over a range of temperatures and pressures not exceeding approximately 600° F. and approximately 10 atmospheres.

5. A method as set forth in claim 3 in which the fossil fuel resource is granulated or crushed shale kerogen, and the mixture of the shale kerogen and hydrogen-donor solvent is irradiated with radiation on the order of 100 Megards.

6. An energy-efficient method for the liquefaction of coal at or near ambient temperatures and pressures which comprises mixing crushed coal with an n-heptane solvent which acts as a hydrogen donor, irradiating the mixture with ionizing radiation to activate the solvent into association with available carbon radicals formed by carbon-carbon bond rupture in the crushed coal thereby to form a liquified product, and extracting the liquified product from the mixture.

7. A method as set forth in claim 6 in which the solvent provides donor hydrogen for association with the carbon radicals so that the liquified product comprises free hydrocarbons having relatively low molecular weights in the range of gases and light liquids.

* * * * *